US005583624A

United States Patent [19]

Heigl

[11] Patent Number: 5,583,624

[45] Date of Patent: Dec. 10, 1996

[54] DEVICE FOR THE RELEASABLE FASTENING OF A FIXING DRUM TO BEARING FLANGES OF A FIXING STATION IN AN ELECTROPHOTOGRAPHIC PRINTER OR COPIER APPARATUS

[75] Inventor: Karl Heigl, Kirchheim, Germany

[73] Assignee: Siemens Nixdorf Informationssysteme Aktiengesellschaft, Paderborn, Germany

[21] Appl. No.: 302,687

[22] PCT Filed: Mar. 10, 1993

[86] PCT No.: PCT/DE93/00222

§ 371 Date: Sep. 8, 1994

§ 102(e) Date: Sep. 8, 1994

[87] PCT Pub. No.: WO93/19401

PCT Pub. Date: Sep. 30, 1993

[30] Foreign Application Priority Data

Mar. 24, 1991 [DE] Germany ..... 42 09 520.4

[51] Int. Cl.[6] ..... G03G 15/20; G03G 21/00

[52] U.S. Cl. ..... 355/282; 355/285; 492/21; 492/45

[58] Field of Search ..... 355/282, 285, 355/286, 287, 288, 289, 290, 291; 492/21, 45, 47

[56] References Cited

U.S. PATENT DOCUMENTS

| | | | |
|---|---|---|---|
| 3,794,417 | 2/1974 | Machmer | 355/290 |
| 3,989,372 | 11/1976 | Davidge et al. | 355/298 |
| 3,990,391 | 11/1976 | Singh | 492/47 X |
| 4,229,950 | 10/1980 | Fessenden | 64/5 |
| 4,800,644 | 1/1989 | Muellenberg | 492/21 |
| 4,890,372 | 1/1990 | Halttula | 492/47 |

FOREIGN PATENT DOCUMENTS

| | | | |
|---|---|---|---|
| WO91/09351 | 6/1991 | WIPO | G03G 15/20 |

*Primary Examiner*—Fred L. Braun
*Attorney, Agent, or Firm*—Hill, Steadman & Simpson

[57] ABSTRACT

A device for the releasable fastening of a fixing drum on a bearing flange of a fixing station in an electrophotographic printer or copier apparatus has a cone-shaped spreader element allocated to the bearing flange and also has a resiliently designed receptacle bushing having an inwardly disposed counter-cone that embraces the spreader element in the fashion of a collet chuck. An outwardly disposed seating surface for the seating of the receptacle bushing is provided at an inside radius of the fixing drum. For the fastening of the fixing drum on the bearing flange the spreader element spreads the receptacle bushing and presses it against the inside radius of the fixing drum.

8 Claims, 2 Drawing Sheets

DEVICE FOR THE RELEASABLE FASTENING OF A FIXING DRUM TO BEARING FLANGES OF A FIXING STATION IN AN ELECTROPHOTOGRAPHIC PRINTER OR COPIER APPARATUS

BACKGROUND OF THE INVENTION

It is standard in electrophotographic printer or copier devices to fix the toner-coated recording medium in a thermal fixing station. Such thermal fixing stations generally contain electrically heated fixing drums with applicable pressure rollers that can be pivoted in and out. For fixing, the recording medium is conducted past between the fixing drum and the pressure roller. The toner is fixed on the recording medium due to the application of heat from the side of the fixing drum. Since the toner must be brought to melting temperature during the short contacting distance of the recording medium with the fixing drum, a high heating capacity on the part of the fixing drum is necessary. For this purpose it is standard to install halogen radiators having a high heating capacity in the hollow fixing drum. Both the halogen radiators in the fixing drum as well as the fixing drum itself are subject to wear, so that it is necessary from time to time to replace the halogen radiators and the fixing drum.

In order to be able to replace the fixing drum in its hot condition as well, PCT WO 91/09 351 discloses that the fixing drum be seated in bearing flanges, whereby the one bearing flange is permanently secured and the other bearing flange is releasably secured in the device. The releasable bearing flange comprises holder elements for the fixing drum as well as a gripping member with which the bearing flange together with the fixing drum appended thereto can be removed from the fixing station. The releasable bearing flange is then separated from the worn fixing drum and is put in place on a new, replacement fixing drum which is then introduced into the fixing station via the bearing flange.

It has proven disadvantageous given this known apparatus to introduce the cold, new fixing drum into the fixing station via the releasable bearing flange since this can be done only after a cool-down time. Due to the relatively high thermal capacity of the fixing station, cools only slowly after shut-off, so that the bearing flange remaining in the fixing station is more greatly expanded due to the heat than the new, cold fixing drum. It is thus not possible during the cool-down time to put the new fixing drum in place on the bearing flange situated in the fixing station. Smaller problems arise in conjunction with the releasable bearing flange when put in place onto the new fixing drum. Here, too, it is necessary to allow the releasable bearing flange to cool.

SUMMARY OF THE INVENTION

It is therefore an object of the invention to offer a device for the releasable fastening of a fixing drum on bearing flanges of a fixing station in an electrophotographic printer or copier device which enables the bearing flanges and fixing drum to be joined to one another or, respectively, to be released from one another even when the fixing drum and the bearing flange have different temperatures.

In an apparatus of this type, this object is achieved by providing a cone-shaped spreader element allocated to the bearing flange of the fixing station. A resiliently designed receptacle bushing having an inwardly disposed counter-cone is provided that embraces the spreader element like a collet chuck and has an outwardly disposed seating surface for seating of the receptacle bushing at an inside radius of the fixing drum. The spreader element spreads the receptacle bushing for fastening the fixing drum on the bearing flange and thus presses it against the inside radius.

According to the invention, receptacle bushings like collet chucks are allocated to the fixing drum receptacle flanges, these receptacle bushings having an inwardly disposed, conical bore. The receptacle bushings are seated on a spreader element in the form of a counter-cone that enters into the conical bores. A straining ring that embraces the receptacle bushings presses the receptacle bushings radially resiliently against the counter-cone of the spreader elements. The receptacle bushings themselves in turn have an outwardly disposed seating surface for seating at an inside radius of the fixing drum, whereby a spring element presses the receptacle bushings axially against a detent of the fixing drum. An effective acceptance diameter of the corresponding bearing flange is thus set, this being smaller than the inside diameter of the fixing drum. The fixing drum can thus be easily slipped onto the flanges. As a result of axial prestress of the flanges, the receptacle bushings are spread over the counter-cone and a clamp-type connection is produced between the fixing drums and the bearing flanges.

For replacing the fixing drums, releasable bearing flanges arranged at the operating side are released and, thus, the axially stressed fastening system is relieved. The receptacle bushings are reduced in diameter by a spring and straining ring, as a result whereof the fixing drum can be unproblemmatically removed from the device via a releasable bearing flange.

It is thus possible to replace the fixing drum without a cool-down time. This considerably shortens the time expended for the replacement of the fixing drum, thus facilitating maintenance of the device and shortening down times.

An embodiment of the invention shall be set forth in greater detail below with reference to the drawings.

DESCRIPTION OF THE PREFERRED EMBODIMENTS

Figure 2:
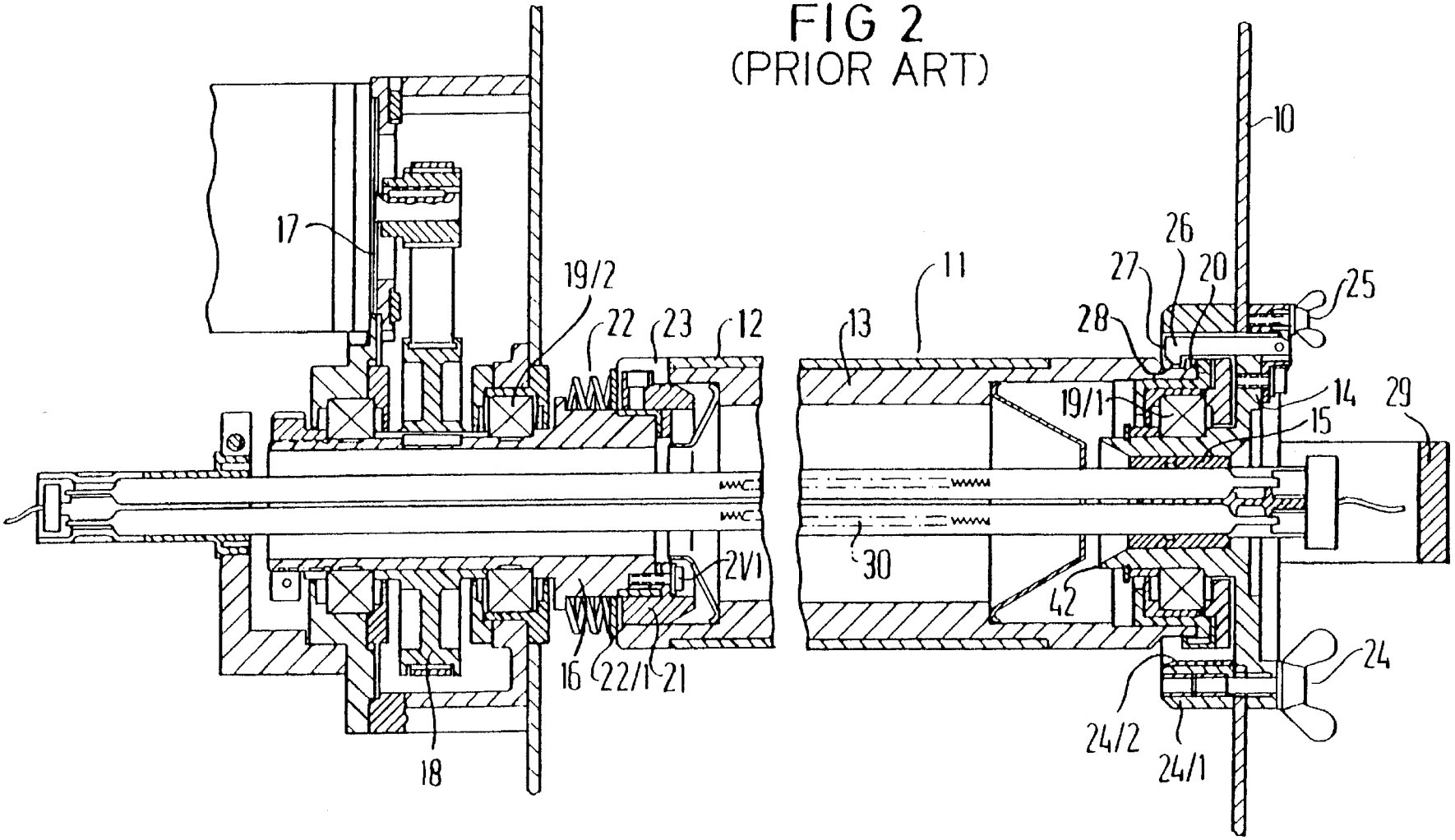
FIG 2 (PRIOR ART)
FIG. 2 is a schematic illustration of a known receptacle means for fixing drums.

A fixing station shown in FIG. 2 and disclosed by NO 91/09 351 for an electrophotographic printer means contains a fixing drum or heating drum 11 that is seated on a frame 10 of the printer device and also comprises a pressure roller (not shown here). The heating drum 11 is composed of an aluminum pipe 13 coated with Teflon 12 that is open at both sides. The heating drum 11 is seated in the frame 10 of the fixing station, namely via a bearing flange 14 having a central holder and guidance opening 15 at the one side and via a bearing element 16 at the other side that is in communication with a drive means 17 in the form of a pulley 18 that are only schematically shown here. A bearing 19/1 that has a centering piece 20 engaging into the aluminum pipe 13 of the heating drum 11 is situated on the bearing flange 14. The other bearing element 16 having the bearing 19/2 at the drive side of the fixing station likewise comprises a centering projection 21 that engages into the other side of the aluminum pipe 13 of the heating drum 11. In order to be able to reliably bear the heating drum 11, Belleville spring washers 22 are arranged on the bearing element 16, these seizing the heating roller via a disk 22/1 and pressing it against the centering piece 20 of the bearing flange 14. They see to the compensation of the axial thermal expansion. The aluminum pipe of the heating drum 11 thereby glides on the centering projection 21, whereby the disk 22/1 is connected to the centering projection 21 via screws 21/1. A dog part 23 at the bearing element 16 engages into a corresponding recess of the aluminum pipe 13 of the heating drum 11 and thus ensures a reliable drive connection. The bearing flange 14 is detachably connected to the frame 10 of the fixing station via some screws 24. With the assistance of retainer claws 26 secured via thumb screws 25, the heating drum 11 is secured relative to the bearing flange 14. For this purpose, the retainer claws 26 have a projection 27 that engages into a channel 28 of the heating drum, whereby the projection 27 does not touch the channel 28 in the built-in condition, so that the heating drum 11 can radially freely move. The retainer claws 26 have a securing function for the replacement of the fixing drum 11.

For replacing the fixing drum, the thumb screws 24 are unscrewed and the fixing drum 11 together with the flange 14 secured by the retainer claws 26 can be pulled from the frame 10 of the fixing station with the assistance of a grip 29 secured to the bearing flange 14 and can be replaced.

So that the generated surface of the fixing drum 11 is not damaged, a retainer ring 24/1 that accepts the thumb screws 24 has its inside covered with felt 24/2.

A radiator module 30 composed of a plurality of halogen radiators, for example two halogen radiators arranged above one another, is located in the fixing drum 11. This radiator module is likewise replaceably designed.

When the heating drum 11 is replaced with the assistance of the bearing flange 14 in the known apparatus in its hot condition, then the problem arises that the flange 14 cannot be directly put in place via its centering piece 20 on a new fixing drum as a consequence of the thermal expansion of the flange 14. A cool-down time must elapse. The same is true for putting the fixing drum in place on the centering projection 21 when the fixing drum is inserted into the fixing station.

Figure 1:
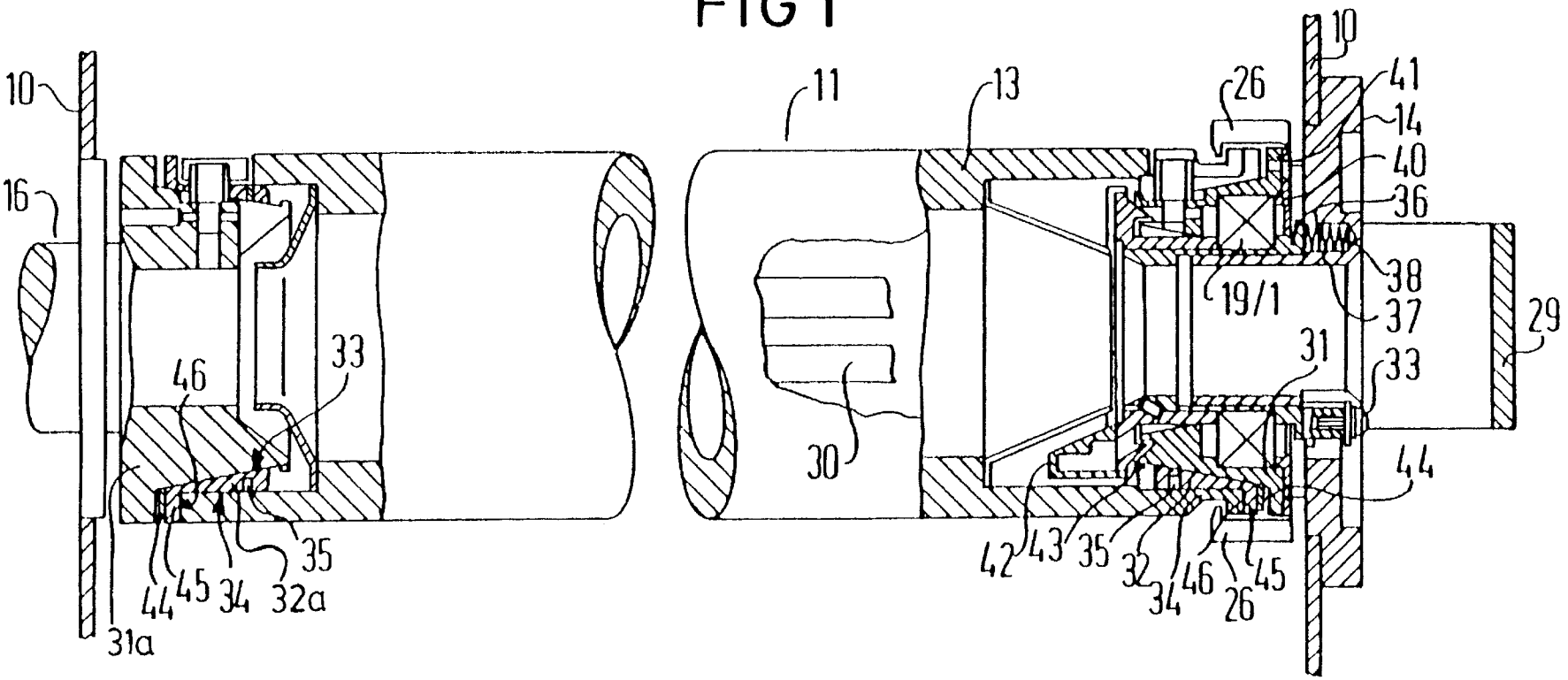
FIG. 1 is a schematic, sectional view of a fixing drum having bearing flanges put in place.

Replacing the fixing drum even in its hot condition and without having to observe a cool-down time is unproblemmatically possible with the apparatus shown in FIG. 1.

Elements having the same functions in FIGS. 1 and 2 are thereby referenced with the same reference characters.

Both the releasable bearing flange 14 at the operating side as well as the bearing flange 16 (bearing element) rigidly secured to the frame comprise a conical spreader element 31 or, respectively, 31*a*. The spreader elements 31, 31*a* are, respectively, embraced by receptacle bushings 32 or, respectively, 32*a* that are resiliently fashioned and that comprise an inwardly disposed counter-cone 33 and an outwardly disposed seating surface 34. The receptacle bushings 32, 32*a* are composed of bronze and have a heat-resistant glide layer of plastic, for example of Teflon on their counter-cone 33. For producing the spring effect of the receptacle bushings 32, 32*a*, the receptacle bushings 32, 32*a* are embraced by a straining ring 35. In the illustrated exemplary embodiment, spreader elements 31, 31*a* and receptacle bushings 32, 32*a* are allocated to the bearing flanges 14 and, respectively, 16. However, it is also possible to allocate the receptacle bushings 32, 32*a* to the fixing drum 11 and to allocate the spreader elements 31, 31*a* to the bearing flange.

At the releasable bearing flange 14, receptacle bushing 32 and spreader element 31 are rotatably seated on a holder 36 which is in turn driven in axially displaceable fashion on a guide 37 of the bearing flange 14. Spring elements that serve the purpose of compensating the thermal axial motion of the fixing drum are arranged between holder 36 and bearing flange 14. In terms of their function, these spring elements 38 correspond to the Belleville spring washers 22 of the apparatus of FIG. 2. A bearing 19/1 is provided for the rotatable seating of the receptacle bushing 32 and of the spreader element 31. The bearing is thereby secured via locking screws. It is situated in a bearing cage that is formed by the spreader element 31 and by a lock washer 40. Lock washer 40 and spreader element 31 are connected to one another via locking screws 41. Further, a receptacle container 42 for collecting abrasion and lubrication losses from the bearing is provided at the holder 36.

The receptacle bushings 32, 32*a* are seated axially moveable on the spreader elements 31, 31*a*, whereby lock noses 43 fashioned at the spreader elements 31, 31*a* secure the receptacle bushings 32, 32*a* on the spreader elements 31, 31*a*. A compression spring elements 44, for example in the form of an ondular washer, are arranged between receptacle bushings 32, 32*a* and spreader elements 31, 31*a*, these compression spring elements 44 pressing the receptacle bushings 32, 32*a* via detents 45 against detent surfaces 46 (edge) of the fixing drum 11 in the built-in condition of the fixing drum shown in FIG. 1. When producing a clamp-type connection by introducing the spreader elements 31, 31*a* into the receptacle bushings 32, 32*a*, the compression spring elements 44 are clamped against the frame 10 when the bearing flange 14 is screwed down. When releasing the clamp-type connection by unscrewing the bearing flange, the compression spring elements 44 axially displace the receptacle bushings 32, 32*a* on the spreader elements 31, 31*a*. As a result thereof, the receptacle radius for accepting the fixing drum is reduced, i.e. the receptacle diameter for the fixing drum formed by the receptacle bushings becomes approximately 1 mm smaller than the inside diameter of the fixing drum. This enables an easy introduction of the bearing flange into the fixing drum and a release of the bearing flange from the fixing drum under all thermal conditions.

Given the operating position shown in FIG. 1, the fixing drum 11 is secured in axially stressed in the frame 10 via the bearing flanges 14 and 16. In this condition, the spreader elements 31, 31*a* press the receptacle bushings 32, 32*a* against an inside radius of the fixing drum 11 and, thus, see to a rotational clamp-type connection between the bearing flanges 14 and 16 and the fixing drum.

Analogous to the known device of FIG. 2, the operating side bearing flange 14 is released from the frame 10 via the thumb screws 24 for replacing the fixing drum 11. As a result thereof, the fastening system axially relaxes and the acceptance radius of the bearing flanges 14 and 16 for the fixing drum is reduced via the receptacle bushings 32, 32*a* in the way that has been set forth. The fixing drum 11 together with the flange 14, secured by the retainer claws 26, can now be pulled from the frame 10 of the fixing station with the assistance of the grip 29 secured to the bearing flange 14. After unscrewing the thumb screws, the bearing flange 14 can be released from the fixing drum. After this, the bearing flange 14 is put in place on a new, ready, cold fixing drum and is secured with the assistance of the retainer claws 26. The new, cold fixing drum can then be introduced into the fixing station with the assistance of the grip element 29 secured to the bearing flange 14 and can be put in place on the bearing flange 16 rigidly attached to the frame. Although the bearing flange 16 remaining in the frame 10 is still warm, it has a smaller acceptance radius than the fixing drum because of the displacement of the receptacle bushing 32*a* in the bearing flange 16 and can therefore easily accept the fixing drum. The fixing drum is axially clamped between the bearing flanges 14 and 16 by screwing the thumb screws 24 down and, thus, the required clamp-type connection between bearing flanges and fixing drum is produced.

Although various minor changes and modifications might be proposed by those skilled in the art, it will be apparent that I wish to include within the scope of the patent warranted heron all such changes and modifications as reasonably come within my contribution to the art.

I claim:

1. A device for releasable fastening of a fixing drum on a bearing flange of a fixing station of an electrophotographic printer or copier device, comprising:

the bearing flange having a cone-shaped spreader element mounted therein;

a resiliently designed receptacle bushing having an inwardly disposed counter-cone surface that embraces the spreader element like a collet chuck and having an outwardly disposed seating surface for seating of the receptacle bushing at an inside radius of the fixing drum, the receptacle bushing being designed so that the spreader element spreads the receptacle bushing for fastening the fixing drum on the bearing flange by pressing the seating surface against the inside radius of the fixing drum; and the receptacle bushing being embraced by a straining ring.

2. A device according to claim 1 wherein the spreader element is surrounded by the receptacle bushing, said receptacle bushing being mounted to the bearing flange.

3. A device according to claim 1 wherein the fixing drum is secured in axially stressed fashion in the fixing station via the bearing flange comprising first and second bearing flange elements engaging at both sides at the fixing drum, the first bearing flange element being rigidly secured to a frame and the second bearing flange element being arranged releasable from the frame, the second bearing flange element comprising holder elements that are designed such that the holder elements engage at the fixing drum after the release of the second bearing flange element, the fixing drum being pulled from the fixing station via the second bearing flange element.

4. A device according to claim 3 wherein the receptacle bushing and spreader element are rotatably seated on a holder which is in turn axially displaceably guided on a guide of the second bearing flange element, a spring element for compensating the thermal axial motion of the fixing drum being arranged between the holder and the second bearing flange element.

5. A device according to claim 1 wherein the receptacle bushing comprises a layer having gliding quality, and is formed of a heat-resistant plastic at least on its inwardly disposed counter-cone.

6. A device for releasable fastening of a fixing drum on a bearing flange of a fixing station of an electrophotographic printer or copier device, comprising:

the bearing flange having a cone-shaped spreader element mounted therein;

a resiliently designed receptacle bushing having an inwardly disposed counter-cone surface that embraces the spreader element like a collet chuck and having an outwardly disposed seating surface for seating of the receptacle bushing at an inside radius of the fixing drum, the receptacle bushing being designed so that the spreader element spreads the receptacle bushing for fastening the fixing drum on the bearing flange by pressing the seating surface against the inside radius of the fixing drum; and a compression spring element engaging at the receptacle bushing and arranged such that the spring element is tensioned due to introduction of the spreader element into the receptacle bushing when producing a clamp-type connection, and after releasing the clamp-type connection, the spring element being arranged to displace the receptacle bushing and spreader element relative to one another, as a result of which a receptacle radius for acceptance of the fixing drum is formed that is smaller than the inside radius of the fixing drum.

7. A device according to claim 6 wherein the receptacle bushing is supported via a detent on a seating surface of the fixing drum.

8. A system for releasable fastening of a fixing drum in a fixing station of an electro-photographic printer or copier device, comprising:

a fixing station of an electro-photographic printer or copier device, said fixing station having first and second bearing flanges;

a fixing drum receivable on said first and second bearing flanges at opposite ends thereof;

a cone-shaped spreader element mounted via a bearing to said first bearing flange, said spreader element having a radially outwardly facing cone-shaped sliding surface;

a resilient receptacle bushing formed as a resilient split ring around said cone-shaped spreader element, said receptacle bushing having an inwardly disposed counter cone-shaped surface for embracing the spreader element and having an outwardly disposed seating surface for seating in outward radial fashion against an inside radius of the fixing drum when the spreader element spreads the split ring receptacle bushing as the receptacle bushing is slid axially along the spreader element sliding surface; and the receptacle bushing being embraced by a straining ring.

* * * * *